United States Patent [19]

Zoltan

[11] 4,419,016

[45] Dec. 6, 1983

[54] DEVICE FOR INDICATING LAST MEDICATION USAGE

[75] Inventor: Bart J. Zoltan, Old Tappan, N.J.

[73] Assignee: American Cyanamid Company, Stamford, Conn.

[21] Appl. No.: 394,579

[22] Filed: Jul. 2, 1982

[51] Int. Cl.[3] ..... G04B 47/00

[52] U.S. Cl. ..... 368/10; 215/DIG. 3; 221/2; 368/109; 368/89

[58] Field of Search ..... 368/10, 12, 97, 98, 368/109, 215, 89; 340/390.1, 390.4; 215/DIG. 3; 221/2

[56] References Cited

U.S. PATENT DOCUMENTS

| | | | |
|---|---|---|---|
| 3,911,856 | 10/1975 | Ewing | 220/327 |
| 4,034,757 | 7/1977 | Glover | 222/30 |
| 4,038,937 | 8/1977 | Moe | 116/121 |
| 4,158,411 | 6/1979 | Hall et al. | 206/531 |
| 4,223,801 | 9/1980 | Carlson | 221/3 |
| 4,275,384 | 6/1981 | Hicks et al. | 221/2 |
| 4,295,567 | 10/1981 | Knudsen | 206/534 |
| 4,361,408 | 11/1982 | Wirtschafer | 221/2 |
| 4,367,955 | 1/1983 | Ballew | 368/98 |

*Primary Examiner*—Bernard Roskoski
*Attorney, Agent, or Firm*—Alphonse R. Noë

[57] ABSTRACT

A patient medication use compliance aid which enables the users to readily ascertain the time at which they took a previous dose of medication. A time keeping device is incorporated into a typical container for medicinal products without the need for complicated container construction or complex mechanical parts or expensive electronic circuitry. The time keeping device displays the time and day of the week when the container was last opened by the patient-user and continues to display the same, even after closing of the container, to serve as a reminder. The time keeping device may also be provided with settable alarms to visually or audibly alert the patient as to when the next dose is to be taken. The compliance aid device can be conveniently provided as a separate element or as part of the cap or cover of a container so that it may be adapted for use with standard containers and need not be integral with or part of a medication container as such but rather can be utilized as a reusable item with fresh containers.

12 Claims, 9 Drawing Figures

DEVICE FOR INDICATING LAST MEDICATION USAGE

BACKGROUND OF THE INVENTION

This invention relates to medication use and, more particularly, to a device for facilitating patient compliance with a prescribed regimen of medication.

The importance of adhering to a prescribed regimen of medication use has been well documented. Not only is it frequently necessary that pharmaceutical preparations be taken in a certain sequence in order to assure their effectiveness but, also, the failure to adhere to timing, such as, for example, by taking the prescribed medication too seldom or often may result in serious adverse effects. Yet, studies have shown that about twenty percent of the medication dosages prescribed by physicians are inadvertently not taken by the patient. The problem is particulaly acute among those who are the greatest users of drugs and other medicines, the elderly and infirm and the chronically ill. Such patients are frequently required to take a plurality of drugs in a specified frequency and sequence. However, often such patients have difficulty recalling the time at which a previous dose of medicine was taken or whether it had been taken at all.

There have been prior art attempts at assuring patient compliance to a drug therapy regimen. Some of these attempts have been directed at the provision of dispensing containers in which each individual dosage unit is provided in a separate compartment with each of the compartments identifiable to a particular date, time of day and/or numerical sequence through appropriate indicia. Examples of such containers are shown in U.S. Pat. Nos. 4,038,937; 4,158,411 and 4,295,567.

Other approaches to the problem have relied upon the use of calendar indicators and timers which can be set and are provied together with individualized compartments for the dosage unit of the medication to be taken. For example, U.S. Pat. No. 3,911,856 discloses a dispenser and schedule reminder in which individual compartments are filled with medicinal tablets and marked with indicia such as certain hours of the day. At the prescribed time, the user rotates the cap to uncover the desired compartment for access to the medication. A date selector as well as a timer which can be set for the period to provide an indication as to the next time to use the medication is included in the dispenser.

Yet other approaches rely upon the use of electronic circuitry. U.S. Pat. No. 4,034,757 discloses a pharmaceutical container having a patient compliance monitor. The container includes two compartments, one for the medication and the other for the recording circuitry. The electronic circuitry is activated upon removal of the cap and when the container is inverted as a result of which data is stored in an addressable memory. The memory is subsequently read by a clinician by removing a portion of the container to obtain access to a multi-pin jack for connection to an external clock pulse. The patent states that the device contains "relatively expensive circuit elements".

U.S. Pat. No. 4,223,801 discloses an automatic periodic drug dispensing system which includes a multi-compartment container each compartment of which is color coded with colors corresponding to those appearing as dots on the face of a watch to indicate when the medication contained in the compartment should be taken. Another embodiment involves a timer integral with the container which signals when the medication should be taken and switching means which must be activated by the user to eliminate the signal and open the compartment for access to the medication. Yet another embodiment relies upon a paging signal broadcast by UHF radio by the supplier of the device and received by crystals in the device according to the regimen prescribed for the particular user of the device.

Although the prior art attempts have been many and varied, each of them possesses disadvantages. For example, those dispensing containers which rely on identifiable compartments merely indicate when a medication is taken but do not indicate whether or not the last medication taken was taken on time. In addition, such devices, particularly where incorporating timing and other means, are bulky and inconvenient. The devices shown in U.S. Pat. No. 4,223,801 are mechanically and electronically complex as well as impractical and likely difficult to use by the elderly and infirm. The dispenser disclosed in U.S. Pat. No. 4,034,757 is merely for subsequent monitoring by a clinician and does not serve the purpose of reminding the patient of a drug therapy regimen. Thus, there remains a need for an effective device to assure patient compliance with a prescribed regimen of medication. Such a device is desirably uncomplicated and easy to use as well as economical to manufacture in order to promote commercial availability and widespread use in order to genuinely achive the intended purpose of making medication therapy more effective, particularly for the elderly and chronically ill.

SUMMARY OF THE INVENTION

The present invention overcomes disadvantages associated with the prior art attempts and provides a patient medication use compliance aid which enables the users to readily ascertain the time at which they took a previous dose of medication. This is achieved, according to the present invention, through the provision of a time keeping device incorporated into typical containers for medicinal products without the need for complicated container construction or complex mechanical parts or expensive electronic circuitry. The time keeping device displays the time and date when the container was last opened by the patient-user and continues to display the same, even after closing of the container, to serve as a remainder. The time keeping device may also be provided with settable alarms to visually or audibly alert the patient as to when the next dose is to be taken.

Thus, an object of this invention is the provision of a medication use compliance aid device which is convenient to use and comparatively uncomplicated to manufacture.

A further object of this invention is the provision of a medication use compliance aid which provides the patient with information concerning the last time at which medication was taken.

The compliance aid device can be conveniently provided as a separate element or as part of the cap or cover of a container so that it may be adapted for use with standard containers and need not be integral with or part of a medication container as such but rather can be utilized as a reusable item with fresh containers. This reduces the net cost of the compliance aid device and may result in a greater acceptance.

Thus, a yet further object of this invention is the provision of a medication use compliance aid device which is separable from the medication container and adaptable for reuse with freshly filled containers thus reducing the overall complexity and cost of the aid and enhancing its potential for acceptance.

The foregoing and other objects, advantages and features of this invention will be further apparent from the following description of preferred embodiments thereof, taken in conjunction with the accompanying drawings and the claims appended hereto.

DESCRIPTION OF THE PREFERRED EMBODIMENTS

Figure 1:
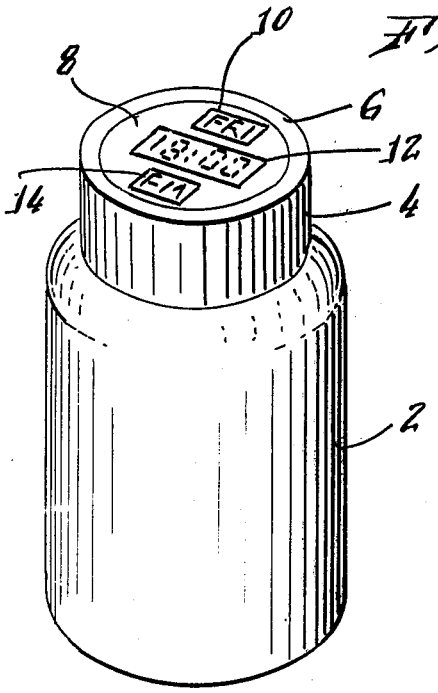
FIG. 1 is a perspective view of a pharmaceutical container including the medication use compliance aid device according to an embodiment of the invention.

Referring to FIG. 1, there is shown a pharmaceutical vial container 2 having a cap 4 incorporating a medication use compliance aid device according to an embodiment of this invention. The compliance aid device, referred to generally at 6, shown in further detail in FIG. 2, includes a time keeping device 8 having displays 10, 12 and 14 which indicate, respectively, the day of the week, the time to the hour and minute and whether it is a.m. or p.m.

Figure 2:
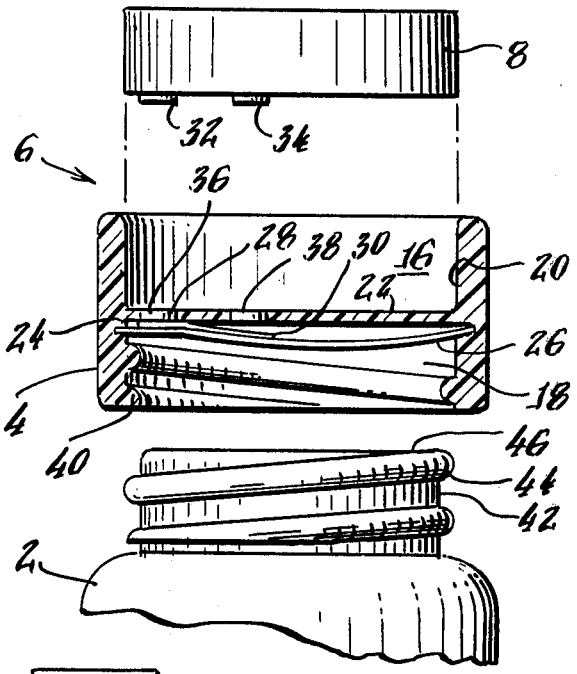
FIG. 2 is a side detail view, partly in section, showing a portion of the pharmaceutical container and the cap with the compliance aid, in exploded relationship, shown in FIG. 1.

The cap 4 is divided into two compartments 16 and 18 by means of the cap circumferential side wall 20 and a dividing partition 22. The upper compartment 16 accommodates the time keeping device 8 which is held therein by appropriate adhesive, or by plotting as is common with electrical components, in a manner such that the displays 10, 12 and 14 are viewable to the user by looking at the top of the cap 4. The lower compartment 18 contains an electrical contact 24 which includes a resilient or spring-like member 26 and a button contact 28. The resilient member 26 may be of electrically conductive material or may carry on it, as shown in FIG. 2, a conductive element 30.

The time piece 8 has two electrical contacts, 32 and 34, which, when the time piece is inserted in the compartment 16, project through the openings 36 and 38 of the compartment divider 22. The time keeping device contact 32 then makes an electrical contact with the button contact 28 while the time keeping device contact 34 projects through the opening 38 and makes contact with the conductive element 30 only when the resilient member 26 is flexed upwardly. Alternatively, the openings 36 and 38 can be replaced by electrically conductive material which projects upwardly into the compartment 16 and downwardly into the compartment 18 in order to make contact with the time keeping device 8 and with the elements 28 and 30 in a manner similar to the projecting contacts 32 and 34.

The compartment 18 also includes screw threads 40 for fastening the cap 4 onto corresponding threads 44 of the neck 42 of the pharmaceutical vial 2. These can be of standard configuration so that the cap 4 may be configured to fit standard vials or containers. When the cap 4 is threaded to the neck 42 the resilient member 26 contacts the upper annular face 46 of the neck 42 and is flexed upward so that contacts 30 and 34 make electrical contact. In turn, when the cap is unscrewed the contact is broken. The resilient member 26 can constitute a circular pliable liner within the cap so as to segregate completely the compartment 16 and divider 22 from the pharmaceutical vial 2 and its contents. When the cap 4 is removed from the vial 2 and the contact broken, the conductive path between the electrical contacts 32 and 34 of the time keeping device 8 is interupted and this interuption is utilized to sense the "cap-off" position whereas the continuous path formed when the cap is threaded on is used to sense the "cap-on" position so that the contacts, conductive member and resilient member together constitutes a sensor.

Figure 3:
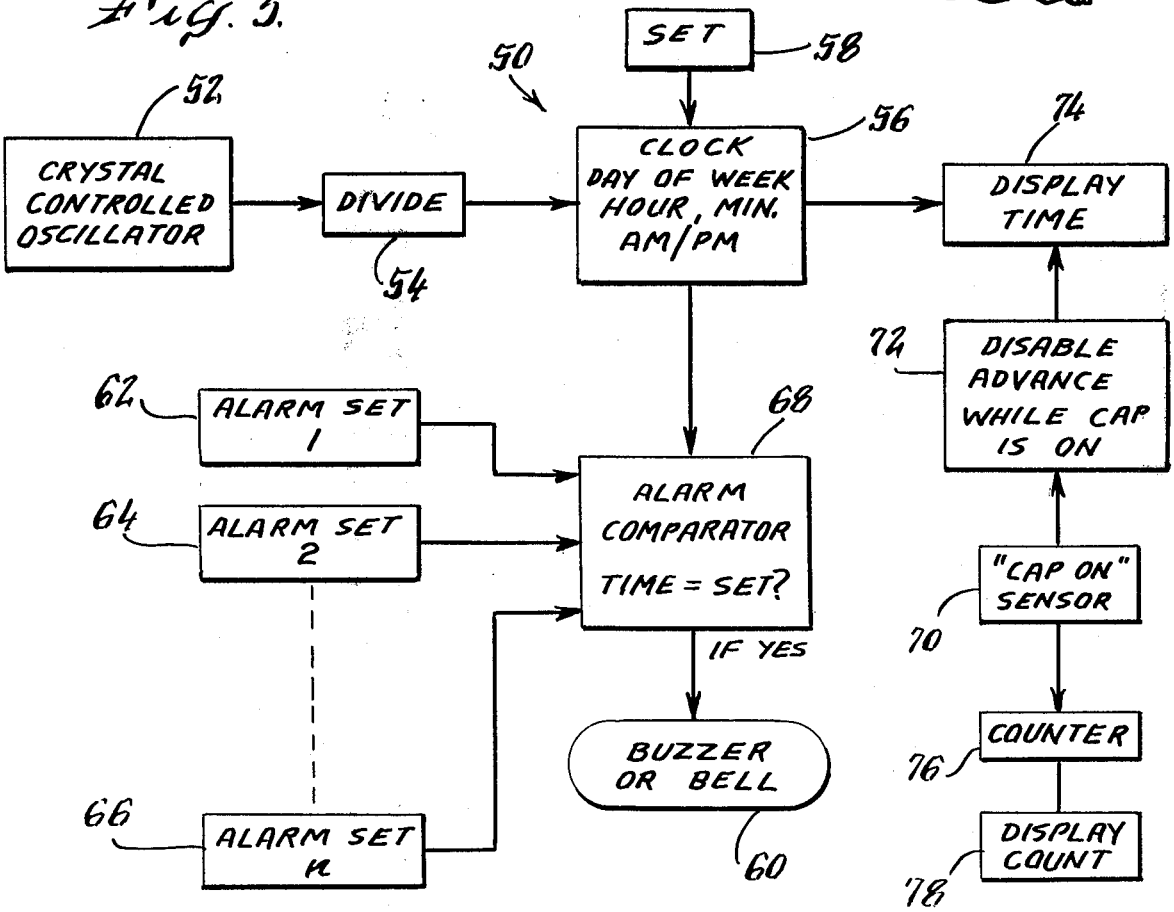
FIG. 3 is a schematic block diagram of the electronic circuitry of the medication use compliance aid device according to embodiments of this invention.

FIG. 3 illustrates the circuitry of the time piece 8 in schematic block diagram form. The individual electronic components are well known to those skilled in the art and of the type available in commercial electronic time keeping devices such as digital clocks and watches. The circuit 50 includes a crystal controlled oscillator 52, a divide down circuit 54 and clock circuitry 56 to convert the divided down pulses to time of day, day of week and a.m. or p.m. Also included is an appropriate means 58 to set the current time in the clock 56. The circuit, in one of the preferred embodiments, also includes an alarm which in this case is indicated as an aural alarm 60, such as a buzzer or bell, and alarm set controls 62, 64 and 66. A comparator circuit 68 compares the signal from the clock 56 with the set point of the alarm 62, 64 and 66 and, if the two are identical, activates the buzzer or bell 60.

The "cap-on" sensor 70 is activated when the cap 4 is secured to the vial 2 and a continuous circuit exists between the contacts 32 and 34 of the time keeping device 8. The "cap-on" sensor 70 sends a signal, when the cap is on, to a display disable advance 72 which processes the signal to keep a display module 74 from changing its indication of time. Thus, when the cap is on, the clock 56 of the time keeping device 8 continues to keep time but the display 74 is held at the last time that the cap was off and the circuit between the contacts 32 and 34 broken to correspond to the instant before the cap was secured. This time is displayed on the displays 10, 12 and 14 which, when consulted by the patient-user, identifies the time when the vial 2 was last open to remove a dosage of medication. Alternatively, the display may indicate elapsed time since the cap was last off thus indicating time since the last dosage. The circuitry also includes a counter 76 and means for displaying the count 78, the function of which will be described in greater detail below with respect to the embodiment illustrated in FIG. 5.

Figure 5:
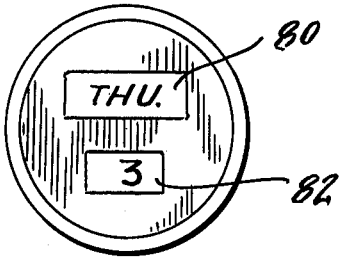
FIG. 5 is a top view of another form of patient information provided by the medication use compliance aid device of the invention.

FIG. 5 illustrates an embodiment in which the day of the week is indicated in a display 80 and another display 22 indicates the number of times that the cap has been removed during that day. When the day in the display 80 changes at midnight, the count shown in the display 82 is reset to 0. The count is derived from a counter 76, FIG. 3, and the display 82 activated by the display count means 78. The count is derived, in this embodiment, from a signal provided by the "cap-on" sensor 70 (FIG. 3). If desired, the number of times which the container has been opened may be shown alone without any day or date.

Figure 4:
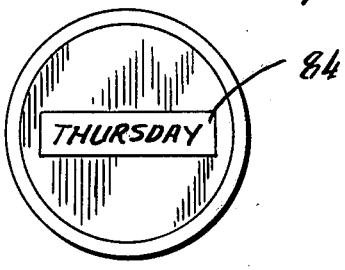
FIG. 4 is a top view of one form of patient information provided by the medication use compliance aid device of the invention.

FIG. 4 illustrates another embodiment of the invention in which the display 84 shows only the day of the week. In this embodiment, the "cap-on" sensor 70, FIG. 3, activates the display disable 72 so that the last day on which the cap 4 has been removed from the vial 2 is displayed. It will be understood that this embodiment is particularly suitable for medications which are taken once a day only while the other embodiments discussed above are applicable to those which are taken several times a day either at a certain time sequence or in a required number.

Figure 6:
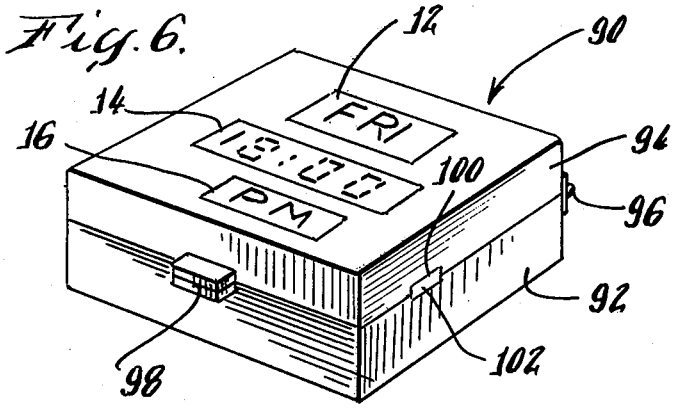
FIG. 6 is a perspective view of a pharmaceutical container with which the medication use compliance aid device is integral according to another embodiment of the invention.

Another embodiment of this invention is illustrated in FIG. 6 in which is shown a container 90 of the pill box type having a lower half 92 and upper half 94 connected by hinge 96. The upper half 94 contains the time keeping device 8 and the displays 12, 14 and 16 visual thereon. The container 90 is kept in a closed position by the clasp 98 in which position contacts 100 and 102 make electrical contact. When the container 90 is opened, the circuit between contacts 100 and 102 is broken. With the container closed the contacts provide a "cap-on" signal to the "cap-on" sensor 70, FIG. 3. The displays 12, 14 and 16 of the container 90 may be appropriately modified to correspond to those shown in FIGS. 4 and 5, also.

Figure 7:
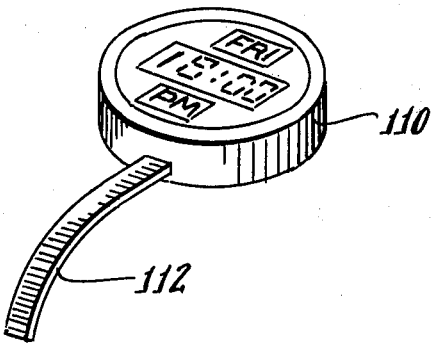
FIG. 7 is a perspective view of the medication use compliance aid device for use with any pharmaceutical container according to another embodiment of the invention.
Figure 8:
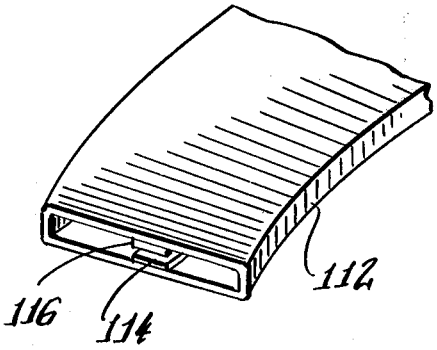
FIG. 8 is a detailed view of the activation sensor of the medication use compliance aid device shown in FIG. 7; and, FIG. 9 is a side view, partly in section, illustrating the use of the medication use compliance aid device mounted on a container.

FIG. 7 illustrates an embodiment of the invention which is useable with existing medication containers. The compliance aid device 110 is identical in all respects to that illustrated in FIG. 2 and contains the circuitry illustrated in FIG. 3 with the exception that in place of the contacts 32 and 34 a fine tube-like extension 112 contains, as illustrated in greater detail in FIG. 8, contacts 114 and 116. The tube extension 112 is made of a flexible material having elastic memory so that it may be squeezed together for the contacts 114 and 116 to make electrical contact and, upon release of pressure, separates so that contact is broken. In this manner, a signal is generated as for the embodiment illustrated in FIG. 2.

Figure 9:
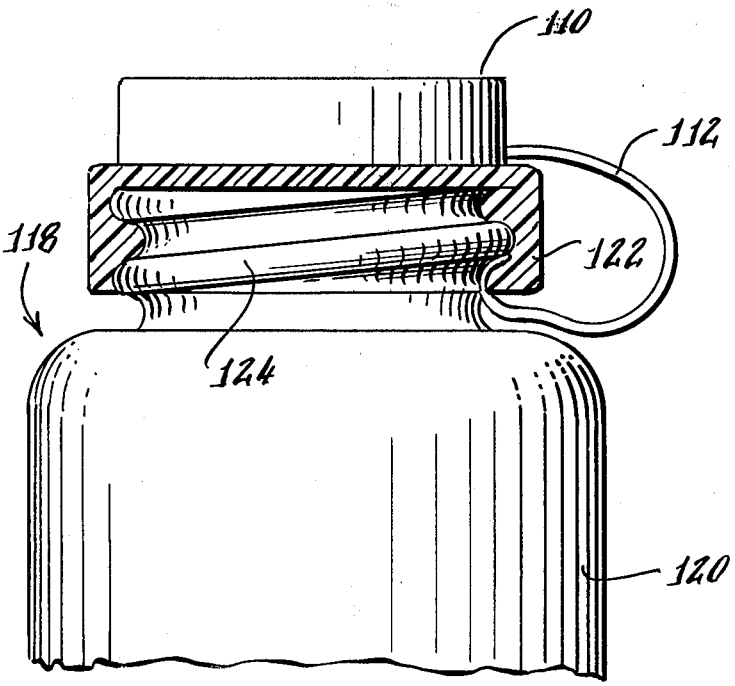

FIG. 9 shows the compliance aid device 110 in use with an existing pharmaceutical vial 118 having a standard body 120 and cap 122. The pliable extension 112 is inserted under cap 122 so that as the cap is threaded on the neck 124, the extension becomes pressed together and contacts 114 and 116 provide a signal to the "cap-on" sensor 70, FIG. 3. The compliance aid device 110 is illustrated in FIG. 9, as resting on top of the cap 122 but could just as well be hanging from the side or otherwise remote. The compliance aid device 110 is thus suitable for use with an already existing cap and container without modification of either.

Thus, there has been disclosed a medication use compliance aid which is relatively uncomplicated, economical to manufacture and simple to use by those most in need of it.

I claim:

1. A device for providing medication use information to aid in patient compliance with a medication use regimen involving dispensing of medication from a container comprising a time keeping means for keeping the correct time selected from the group consisting of minutes, hour, day, date, week and month, and, combinations thereof, the time keeping means including display means to indicate time, sensor means for sensing when a medication container has been opened or closed to dispense medication, and said signal sensing means providing a signal to the time keeping means in response thereto, and signal processing means within the time keeping means for receiving the signal from the sensor means and activating the display means to indicate the time of the signal, the signal processing means including means for maintaining such indication of the time of the signal until a further signal from the sensor means is received by which the patient-user is provided with an indication of the last time the container was opened or closed.

2. A device for providing medication use information to aid in patient compliance with a medication use regimen as claimed in claim 1 where the time keeping means further comprises settable alarm means for alerting the patient-user as to when medication should again be taken.

3. A device for providing medication use information to aid in patient compliance with a medication use regimen as claimed in claim 1 wherein the processing means further comprises means for ascertaining the number of signals received from the sensor means within a given time period and for providing an output in response thereto and the display means further comprises means for displaying a number in response to such output.

4. A device for providing medication use information to aid in patient compliance with a medication use regimen as claimed in claim 1 wherein the time keeping means further comprises means for determining the elapsed time since the last signal from the sensor means and for indicating the same on the display means.

5. A device for providing medication use information to aid in patient compliance with a medication use regimen as claimed in claim 1 wherein the time keeping means further comprises settable means for determining when the medication should again be taken and for indicating the same.

6. A device for providing medication use information to aid in patient compliance with a medication use regimen as claimed in claims 1, 3, 4 or 5 wherein the device is an integral part of a medication container.

7. A device for providing medication use information to aid in patient compliance with a medication use regimen as claimed in claims 1, 3, 4 or 5 wherein the device is an integral part of a medication container cover.

8. A device for providing medication use information to aid in patient compliance with a medication use regimen as claimed in claim 1 wherein the display of the time is selected from the group consisting of the minute, hour, day, date, week and month, and combinations thereof.

9. A device for providing medication use information to aid in patient compliance with a medication use regimen as claimed in claims 1, 3, 4 or 5 wherein the display means displays the correct time and further comprising means for indicating the time of last container opening or closing, signal number or elapsed time solely upon activation of means by the patient-user.

10. A device for providing medication use information to aid in patient compliance with a medication use regimen involving dispensing of medication from a container comprising a medication container cover, time keeping means for keeping the correct time selected from the group consisting of minutes, hour, day, date, week and month, and combinations thereof, located within the cover, the time keeping means including display means to indicate time, sensor means capable of sensing when the cover is removed or replaced on a medication container, the sensor means including at least two electrical contact means capable of forming an electrical circuit when contact is made therebetween, conductive means for contacting the electrical contact means in response to removal or replacement of the cover on the container, means for providing a signal to the time keeping means in response to completing or interrupting a circuit between the electrical contact means, processing means within the time keeping means for receiving the signal and activating the display means to indicate the time of the signal, the processing means including means to maintain such indication until a further such signal is received and provide the patient-user with an indicator of the last time the container cover was removed or replaced.

11. A device for providing medication use information to aid in patient compliance with a medication use regimen as claimed in claim 10 further comprising resilient means operatively connected to the conductive means and capable of being flexed upon removal or replacement of the cover on the container to cause the conductive means to complete or interrupt the circuit.

12. A device for providing medication use information to aid in patient compliance with a medication use regimen as claimed in claim 10 wherein the processing means further comprises means for ascertaining the number of signals received within a given time period and for providing an output in response thereto and the display means further comprises means for displaying a number in response to such output to indicate the number of times the cover has been removed and replaced on the container.

* * * * *